US011308929B2

(12) United States Patent
Huang

(10) Patent No.: US 11,308,929 B2
(45) Date of Patent: Apr. 19, 2022

(54) STRINGED INSTRUMENT PICKUP AND FEEDBACK SYSTEM

(71) Applicant: HUIZHOU DOUBLE ACOUSTICS CO., LTD., Huizhou (CN)

(72) Inventor: Shiqiang Huang, Huizhou (CN)

(73) Assignee: HUIZHOU DOUBLE ACOUSTICS CO., LTD.

( * ) Notice: Subject to any disclaimer, the term of this patent is extended or adjusted under 35 U.S.C. 154(b) by 186 days.

(21) Appl. No.: 16/660,150

(22) Filed: Oct. 22, 2019

(65) Prior Publication Data

US 2020/0118535 A1 Apr. 16, 2020

Related U.S. Application Data

(63) Continuation-in-part of application No. PCT/CN2018/114183, filed on Nov. 6, 2018.

(30) Foreign Application Priority Data

Jan. 12, 2018 (CN) ..... 201520053261.3

(51) Int. Cl.
*G10H 3/18* (2006.01)

(52) U.S. Cl.
CPC ..... *G10H 3/181* (2013.01); *G10H 2220/461* (2013.01)

(58) Field of Classification Search
CPC ..... G10H 3/181; G10H 2220/461
USPC ..... 84/723
See application file for complete search history.

(56) References Cited

U.S. PATENT DOCUMENTS 3,194,870 A * 7/1965 Tondreau ..... G10D 1/085 984/107
3,781,451 A * 12/1973 Nolan ..... G10H 3/18 84/723
4,245,540 A * 1/1981 Groupp ..... G10D 1/085 84/738
4,310,730 A * 1/1982 Aaroe ..... H04R 1/46 381/189
4,472,994 A * 9/1984 Armstrong ..... G10H 3/183 84/743
4,495,641 A * 1/1985 Vernino ..... H04R 1/46 381/174
4,580,479 A * 4/1986 Bonanno ..... G10H 1/46 84/645
4,947,726 A * 8/1990 Takabayashi ..... G10H 3/18 84/723
5,056,400 A * 10/1991 Wachi ..... G10H 3/26 84/723

(Continued)

*Primary Examiner* — Christina M Schreiber
(74) *Attorney, Agent, or Firm* — Scarinci Hollenbeck

(57) ABSTRACT

A stringed instrument pickup and feedback system, comprising a sound pickup device disposed on a string instrument. The sound pickup device comprises a transducer and at least one pickup, a sound processing circuit and a power supply. The pickup activates the transducer to realize resonance enhancement on the instrument body. The transducer is disposed on the string instrument unrestricted by internal bracing. The instrument can be any of pickup, guitar, ukulele, violin, Guqin, Guzheng and Mandolin. The present invention enables the construction of stringed instrument to add vibration and amplify sound of a stringed instrument using the transducer and thus reduce the dependence on rare woods in manufacturing these instruments.

3 Claims, 4 Drawing Sheets

(56) References Cited

U.S. PATENT DOCUMENTS 5,378,850 A * 1/1995 Tumura ..... G10H 3/26 84/738
5,422,955 A * 6/1995 Guzman ..... H04B 1/034 381/118
H1503 H * 12/1995 Threadgill ..... 84/723
5,567,896 A * 10/1996 Gottschall ..... G10D 3/02 84/294
5,866,835 A * 2/1999 Baggs ..... G10H 3/181 84/DIG. 24
6,075,198 A * 6/2000 Grant ..... G10H 3/181 84/723
6,191,350 B1 * 2/2001 Okulov ..... G10H 3/185 84/723
6,271,456 B1 * 8/2001 Nelson ..... G10H 3/188 84/734
6,605,765 B1 * 8/2003 Johnson ..... G10D 3/00 84/267
6,627,808 B1 * 9/2003 Coats ..... G10H 3/186 84/723
7,015,390 B1 * 3/2006 Rogers ..... G10H 1/32 84/723
7,105,731 B1 * 9/2006 Riedl ..... G10H 3/181 84/727
8,389,835 B2 * 3/2013 Findley ..... H04R 7/045 84/743
9,012,758 B2 * 4/2015 El-Khadem ..... G10H 3/18 84/723
9,093,057 B2 * 7/2015 Mejia ..... G10H 1/02
9,799,316 B1 * 10/2017 Owens ..... G10H 1/46
10,304,423 B2 * 5/2019 McAuld ..... H04M 1/04
10,770,047 B2 * 9/2020 Litovsky ..... H04R 1/345
2004/0134334 A1 * 7/2004 Baggs ..... G10H 3/26 84/723
2006/0117938 A1 * 6/2006 Gillette ..... G10H 3/186 84/723
2007/0084335 A1 * 4/2007 Silzel ..... G10H 3/146 84/723
2007/0180975 A1 * 8/2007 Paris ..... G10D 3/02 84/291
2008/0184864 A1 * 8/2008 Holt ..... G10H 3/186 84/267
2012/0240751 A1 * 9/2012 Yonetani ..... G10H 3/18 84/726
2020/0118535 A1 * 4/2020 Huang ..... G10H 3/186

* cited by examiner

STRINGED INSTRUMENT PICKUP AND FEEDBACK SYSTEM

CROSS-REFERENCE TO RELATED APPLICATIONS

The present application is a continuation in part application of International Application No. PCT/CN2018/114183 filed on Nov. 6, 2018, which claims priority to Chinese Patent Application No. 201820053261.3 filed on Jan. 12, 2018 the content of which is incorporated by reference herein in its entirety for all purposes.

FIELD OF ART

The invention is included in the field of instrument sound pickup technology, concerning a stringed instrument pickup and feedback system.

BACKGROUND

Most stringed instruments on the market use a sound cavity to hear or improve the overall sound quality of the instrument. These instruments include guitars, ukuleles, violins, guqins and guzheng. However, the physical properties of the materials used to make such instruments limit the volume of sound produced by such instruments. Simply put the sound amplification will not be too high. When playing instruments without amplification of external speakers, the sound volume is often too low, not loud enough. If the audience is fir away from the performer using the stringed instrument without a speaker, the audience cannot clearly hear the music played by the performer(s), which makes wonderful performances greatly reduced.

In order to solve this drawback, almost all instrument manufacturers in the world spare no efforts to use rare woods in manufacturing instrument. Rare woods have better resonance to increase sound volume and enhance sound quality of instruments. However, use of well-known rare woods in instrument manufacturing works little on enhancing the sound resonance of instruments. Also, when instrument sound cannot be optimized, many instrument manufacturers continue to pursue even rarer and higher-end woods in instrument manufacturing. This results in overcutting of various types of rare woods. Acacia, rosewood, ebony and sandalwood are commonly used to make instruments and these woods suffer devastating worldwide overcutting and are protected by international conventions to curtail such exploitation.

An invention is desired that will enable a performer to play a stringed instrument and get studio-quality post effects like reverb, delay and chorus without an amplifier, sound system or external effects. An invention is desired that improves the sound quality or tone of a stringed musical instrument and simultaneously reduces the dependence on using rare woods by the instrument manufacturing industries. An invention is desired that picks up the sound of an instrument directly. An invention is desired that applies a resonance speaker or a transducer to realize resonance enhancement of an instrument body and make the sound emitted by the instrument stronger. A stringed instrument is desired that employs a transducer coupled to a back of such instrument and uses the inertia of the original note to continue the momentum of an acoustic wave in a sympathetic vibration wherein such a wave is transferred into the wood of the musical instrument thus using the entire body of the musical instrument to amplify the effect. An invention is desired that, in addition to commonly used volume and tone control functions, adds a digital reverberation module and an effect module having good practicability and broad market sales. An invention is further desired to have on-board circuitry to enhance sound and provide thick chorus effect and brilliant acoustic delay that is both speed and depth adjustable. An invention is desired that uses a built-in preamp.

It is further desired to have an invention that amplifies instrument sound. It is desired that a resonance speaker or transducer is clung, affixed or disposed to the inside, back surface of an instrument panel. It is desired that the instrument have a transducer that is permanently fixed to the inside back. It is further desired that the transducer is permanently fixed inside the instrument with adhesive. It is desired that a eat have a device that is able to pick up the sound made by the instrument, enhance resonance of the instrument and increase the sound made by an instrument. It is also desired that an invention permits the manufacture of an instrument while simultaneously promoting environmental protection. It is also desired that an instrument be manufactured with low material cost and manufacturing costs to permit broad market sales and good economic benefit.

SUMMARY

The present invention provides a way to make an instrument sound which has been strengthened while at the same time reduce the manufacturing of instruments with rare or exotic materials. The present invention discloses a stringed instrument pickup and feedback system comprising at least one sound pickup member, an output transducer, and a control processor connected to the at least one sound pickup member and the output transducer, wherein the control processor is configured to receive signals from the at least one sound pickup member corresponding to detected sound from a stringed instrument and process said received signals into output control signals, wherein the control processor is configured to send said output control signals to the output transducer to resonate the output transducer through a predetermined range of frequencies. The transducer is disposed on an inside, back surface of the stringed instrument and connected with a power supply or a power amplifier circuit.

DETAILED DESCRIPTION

Figure 1:
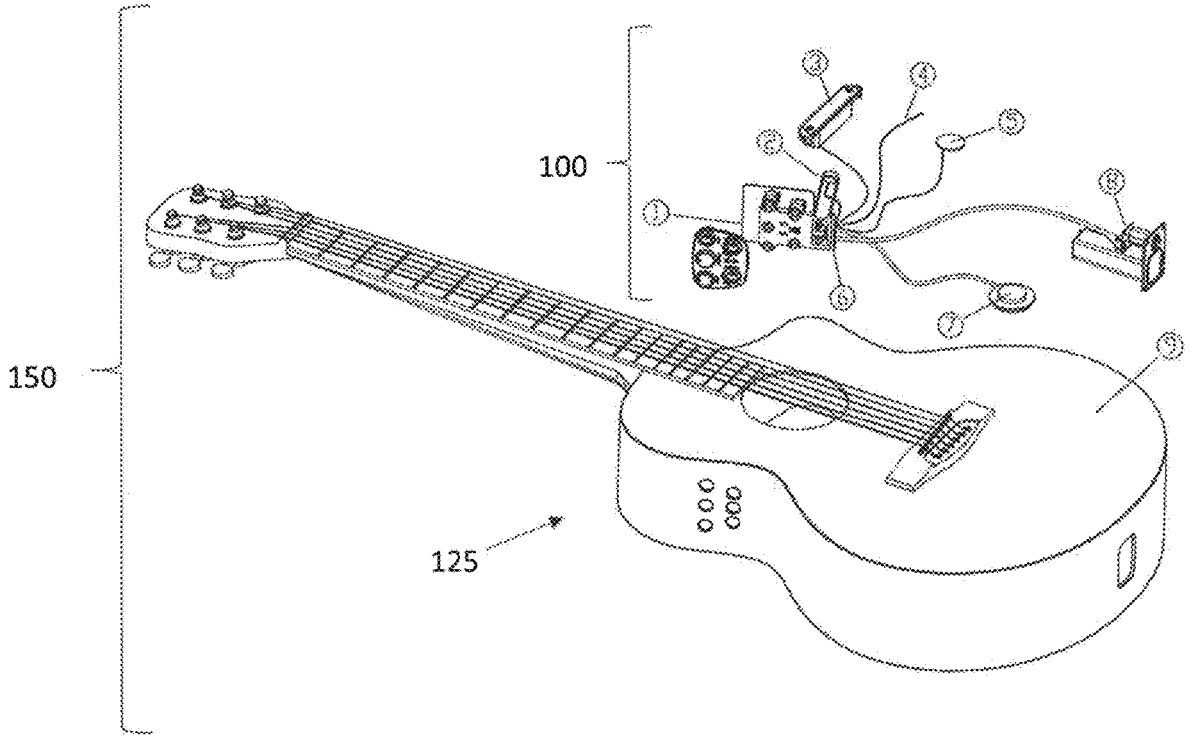
FIG. 1 shows an exploded perspective view of a stringed instrument pickup and feedback system with an instrument pickup and transducer.

FIGS. 1 to 4 show a stringed instrument pickup and feedback system 150 also known as a stringed instrument same-frequency or co-frequency vibration adding/enhancing and sound amplifying/reinforcement technology. The system 150 comprises an instrument 125 and a sound pickup device 100 or called a sound collecting device. The sound pickup device 100 realizes resonance enhancement and sound adding to an instrument body 9 by means of the instrument vibration adding component or an output transducer 7 which may also be called a resonance speaker or resonant horn. The output transducer 7 is disposed on, affixed or clung to the instrument 9 and connected with a power source 8 or power amplifier circuit.

The transducer may be affixed in a number of different ways both within and outside the instrument 9. The transducer 7 may be affixed using any attachment method. In one non-limiting attachment method, the transducer 7 may use a permanent adhesive such that the transducer is affixed to the back surface of the instrument without the need for internal bracing members. In such embodiment using adhesive, the transducer 7 is attached so not to be removed and, if removed, would cause damage to the transducer 7. In yet another embodiment, the transducer 7 may employ magnets such as neodymium rare earth magnets. The use of the transducer 7 in the present invention replicates the digitally affected sound that is achieved when using rare quality woods in stringed instruments. The use of the sound pickup device 100 with the transducer 7 on the instrument body 9 amplifies the instrument sound. Specifically, by affixing a transducer 7 to an inside surface of an instrument panel internal sound is captured and amplified.

Figure 4:
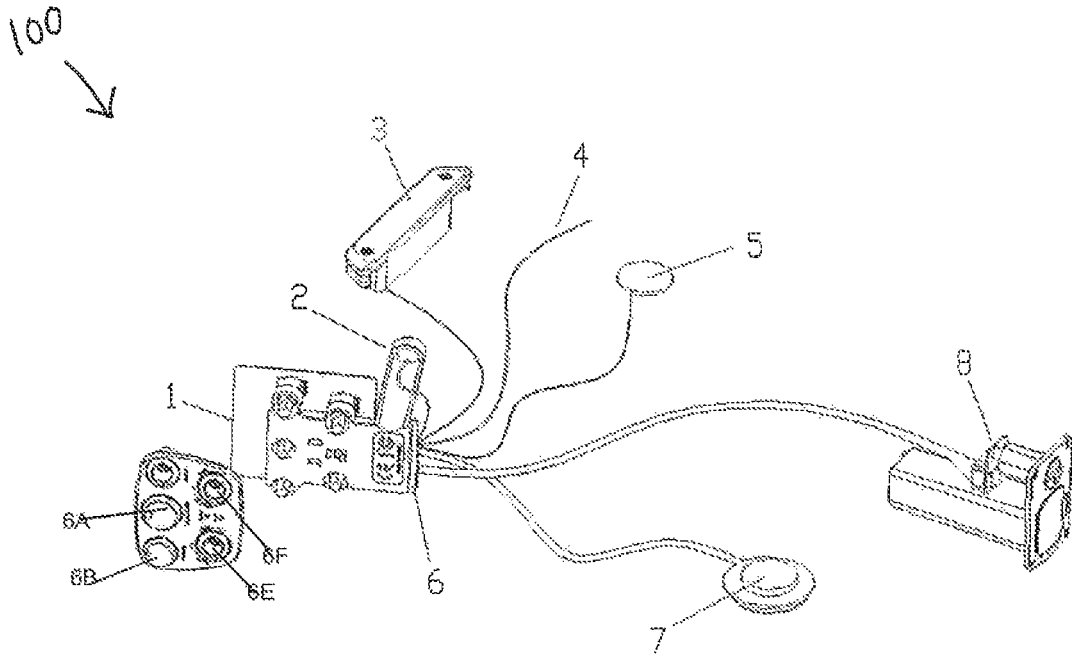
FIG. 4 shows a perspective exploded view of the instrument pickup and transducer.

FIG. 4 shows, the sound pickup device 100 of the stringed instrument pickup and feedback system 150. The sound pickup device 100 comprises a sound pickup assembly, a sound processing circuit 6, a transducer or resonance speaker 7 and a power supply unit 8. In one embodiment, the pickup device 100 is a sound receiver, which unlike prior art devices where pickups sends signals to another device.

The sound pickup assembly comprises a control processor or digital sound processor 1 and a sound pickup part or member 2-5 mounted on or to the instrument body 9. A sound processing circuit 6 is placed inside the instrument body 9. The transducer 7, the sound pickup part or member 2-5 and the power supply unit 8 are each connected with the sound processing circuit 6 by wire, respectively.

Figure 2:
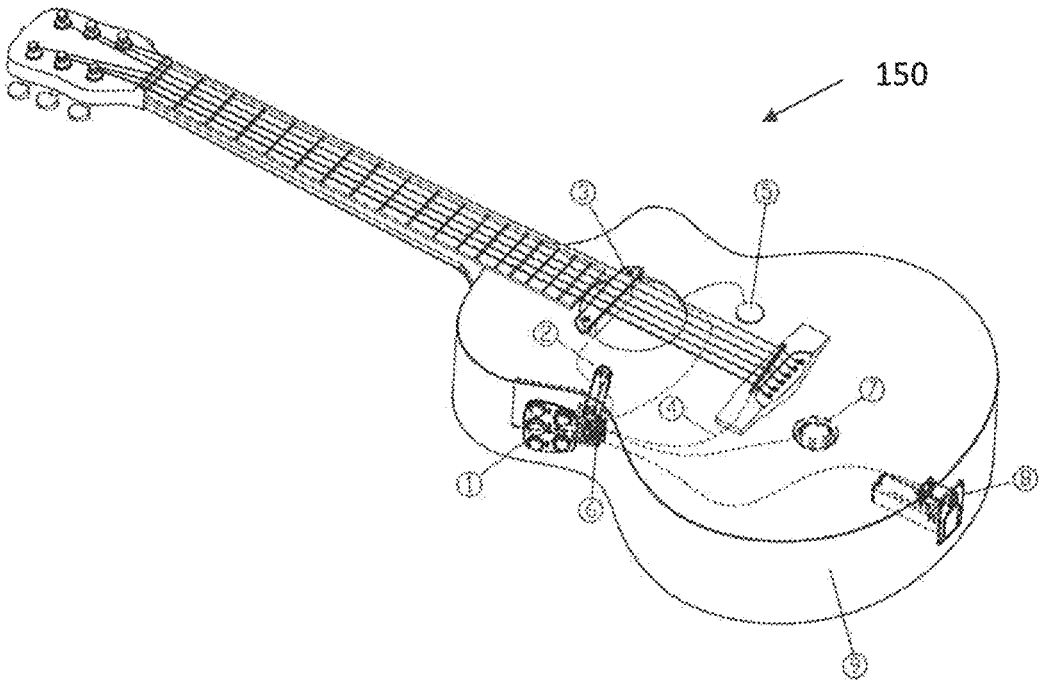
FIG. 2 show a perspective side-view of the stringed instrument pickup and feedback system of FIG. 1, showing the instrument pickup and transducer in an installed position according to an exemplary embodiment.
Figure 3:
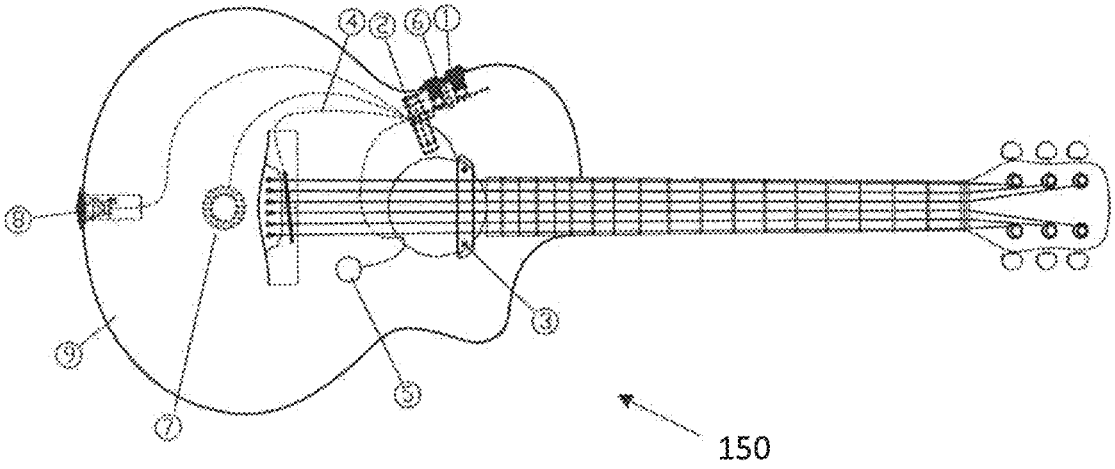
FIG. 3 shows a plan view of the stringed instrument pickup and feedback system of FIG. 1, showing the instrument pickup and transducer iii an installed position.

The sound pickup part or member 2-5 can be any one or two or more of coil inductive pickup or magnetic pickup 3, microphone pickup 2, piezoelectric pickup strip or piezoelectric saddle pickup 4 and patch piezoelectric ceramic buzzer pickup or pressure pickup 5. Each of the pickups 2-5 are designed to detect sound produced by the stringed instrument 9 and convert the detected sound to a corresponding electrical signal. As seen in FIGS. 2-3, microphone pickup 2 is installed within the stringed instrument 9 body.

In one embodiment the four sound pickup part or member 2-5 are disposed within instrument 9, wherein a microphone pickup 2 is mounted at one side of the instrument body 9; while a coil induced pickup or magnetic pickup 3, a piezoelectric pickup strip or piezoelectric saddle pickup 4 and a patch piezoelectric ceramic buzzer pickup or pressure pickup 5 are connected with the sound processing circuit 6 by wires, respectively. In another embodiment, magnetic pickup 3 is installed within the sound hole of stringed instrument 125 directly below the strings. Piezo saddle pickup 4 is installed within the saddle of the stringed instrument 125. Pressure pickup 5 is installed on the stringed instrument body 9 either within the body or on the external surface of the soundboard. The detected signal from each of the pickups 2-5 is converted to an electrical signal which is sent to the control processor 1 via a connecting wire.

The control processor or digital signal processor 1, in an exemplary embodiment, processes detected signals from at least one of pickup types 2-5. It can be appreciated that any combination of pickups or a single pickup can be utilized in the subject invention depending on desired sound characteristics and string instrument type as would be known in the art.

Once control processor or digital sound processor 1 has processed the incoming detected signal from one of the pickups 2-5, an output control signal is sent to output transducer 7. Output transducer 7 converts incoming electrical control signals to a vibration movement which resonates the body of stringed instrument 9. The vibration produced by output transducer 7 can be adjusted by control processor or digital sound processor 1 to produce a tone simulating the use of exotic or rare material for the body of the stringed instrument 9. Output transducer 7 can also be used to increase the output sound of stringed instrument 9 by controlling the output control signal by control processor or digital sound processor 1.

The sound processing circuit 6 comprises a volume control unit 6A, a tone processing unit 6B, a power amplifier circuit, a voltage stabilization circuit, a reverberation module 6E and an effect module 6F, and the units and/or modules are electrically connected. The volume control unit 6A is used for volume control of instrument pickup signals; the timbre/tone processing unit 6B is used for timbre/tone processing of instrument pickup signals; the voltage stabilizing circuit is used for voltage enhancement and stabilization; the reverberation module 6E is used for instrument to have reverberation effect. The reverberation module can be one or several adjustable and optional reverberation control modules. The effect module 6F can be one or several adjustable and optional sound effect control modules. The original sound, such as the sound produced by the instrument, is processed, in one embodiment, with control processor or digital sound processor 1 and sound processing circuit 6. The power supply unit 8 is a power supply device 8 connected to and supplies power to the sound processing circuit 6, the instrument vibration adding/enhancing assembly or transducer 7 and sound pickup assembly comprising control processor 1 and pickup members 2-5.

As shown in FIGS. 1 to 4, for application of the sound pickup device on instrument, the instrument makes use of the sound pickup device to realize resonance enhancement on the instrument body 9 by means of the transducer 7. The transducer 7 is clung, affixed or disposed to the inside surface of instrument panel to realize instrument sound amplification, so that sound quality is clear. This is further made true as the transducer 7 has no box standing wave. Besides, the transducer 7 also has a unique characteristic—penetrability, namely the transducer 7 can let sound effect pass through media and music can be heard at the other side, so that the audience at both sides of media can hear beautiful music. The stringed instrument pickup and feedback system of the invention uses the sound pickup device 100 to resonate the instrument body 9 through the transducer 7 to amplify instrument sound and reduce the dependence of instrument manufacturing industry on rare woods at the same time. The reduction on the dependence on are woods to manufacture instruments, plays a significant role in protecting green forest and promoting worldwide environmental protection, especially for protecting the rare woods commonly used to make instruments.

The device 100 picks up the sound of instrument directly and applies the transducer 7 to achieve resonance enhancement of instrument body, so as to make the sound made by instrument stronger. In addition to commonly used volume and tone control functions, the digital reverberation module and the effect module are especially added. The addition of these modules have good practicability, enables broad market sales prospect and creates good economic benefit.

The present invention would be used on an instrument 125 of any type such as but not limited to a pickup, guitar, ukulele, violin, guqin, guzheng and mandolin. Namely, the stringed instrument pickup and feedback system 150 of the present invention can be applied on a pickup, the pickup makes use of the sound pickup device for the synchronous vibration adding of instrument by means of the transducer 7. Likewise, the present invention can be applied on any stringed instrument, the stringed instrument makes use of the sound pickup device for the resonance enhancement of the instrument body 9 by means of the transducer 7.

Considering the above, the present invention not only amplifies instrument sound but also reduces the dependence of the instrument manufacturing industry on rare woods. A decreased dependence on use of rare woods to manufacture stringed instruments plays a significant role in protecting green forest and promoting worldwide environmental protection, especially for protecting the rare woods commonly used to make instruments. Furthermore, by clinging or disposing of the transducer to the surface of the instrument, the present invention is able to lower material and manufacturing costs to make instruments, resulting in broad market sales prospect and good economic benefit.

While specific embodiments of the invention have been described and illustrated, such embodiments should be considered illustrative of the invention only and not as limiting the invention as construed in accordance with the accompanying claims. One of ordinary skill in the art could alter the above embodiments or provide insubstantial changes that may be made without departing from the scope of the invention. Those skilled in the art can make use of the above technical contents disclosed to make some equivalent changes, such as modification, decoration and evolution without departure from the technical solution of the invention, and they are regarded as equivalent embodiments of the invention; besides, all equivalent changes, such as modification, decoration and evolution made on the above embodiment according to the substantial technology of the invention are within the scope of the technical solution of the invention.

The invention claimed is:

1. A stringed musical instrument having a stringed instrument pickup and feedback system comprising:

at least one sound pickup member;

an output transducer disposed directly on a surface of a stringed musical instrument; and a control processor connected to the at least one sound pickup member and the output transducer, wherein the control processor is configured to receive signals from the at least one sound pickup member corresponding to detected sound from the stringed musical instrument and process said received signals into output control signals, wherein the control processor is configured to send said output control signals to the output transducer to resonate the output transducer through a predetermined range of frequencies, and wherein the output transducer resonates the surface of the stringed musical instrument creating simulated rare wood tones that would emanate from a surface of a rare material constructed stringed musical instrument.

2. The stringed musical instrument of claim 1, wherein the output transducer is disposed directly on a smooth, closed surface of the stringed musical instrument.

3. A method of creating rare wood tones from a non-rare wood stringed musical instrument having a stringed instrument pickup and feedback system comprising:

sending signals from at least one sound pickup member corresponding to detected sound from a non-rare wood stringed musical instrument to a control processor, processing said signals into output control signals, sending said output control signals from the control processor to an output transducer directly placed on the stringed musical instrument to resonate the output transducer through a predetermined range of frequencies, resonating the surface of the stringed musical instrument by the output transducer, and creating, by said resonating surface, rare wood sounding tones that would emanate from a surface of a rare material constructed stringed musical instrument.

* * * * *